United States Patent [19]

Lee et al.

[11] Patent Number: 4,586,355

[45] Date of Patent: May 6, 1986

[54] LOCK CYLINDER COVER WITH KEY ENGAGEMENT RELEASE OF HOLD-OPEN DETENT

[75] Inventors: David N. Lee, Almont; David B. Ballantyne, Bloomfield Hills, both of Mich.

[73] Assignee: General Motors Corporation, Detroit, Mich.

[21] Appl. No.: 717,023

[22] Filed: Mar. 28, 1985

[51] Int. Cl.[4] ..... E05B 17/18

[52] U.S. Cl. ..... 70/455; 70/452

[58] Field of Search ..... 70/455, 55, 372, 423, 70/427, 431, 452

[56] References Cited

U.S. PATENT DOCUMENTS

| | | | |
|---|---|---|---|
| 3,313,136 | 4/1967 | Gupette | 70/455 |
| 3,898,824 | 8/1975 | Borlinghaus | 70/455 |
| 3,930,391 | 1/1976 | Borlinghaus | 70/455 |
| 4,192,161 | 3/1980 | Borlinghaus | 70/455 |

*Primary Examiner*—Robert L. Wolfe

*Attorney, Agent, or Firm*—Charles E. Leahy

[57] ABSTRACT

A lock cylinder cover includes an escutcheon having a lock cylinder opening and a pivotal cover biased to cover the lock cylinder. A spring detent secured to the underside of the escutcheon has a stop surface which bears on the underside of the cover until opening movement permits the detent to spring out and engage a shoulder of the cover to hold the cover open. A blocking lever pivotally mounted on the underside of the escutcheon is spring biased to engage the detent. The detent has a cam surface poised in the path of unlocking rotation of the key so that the key cams the detent inwardly to release the stop surface from the cover so that the cover is spring biased to engage the key and then key removal permits the cover to close. The inward movement of the detent permits the lever to pivot into blocking engagement with the detent to retain the axially inward position in which the stop surface is withdrawn from engaging the cover. As the cover rotates closed, an operating abutment carried by the cover rotates the lever out of blocking engagement with the detent so that the detent is freed for subsequent outward movement upon subsequent opening of the cover.

2 Claims, 5 Drawing Figures

LOCK CYLINDER COVER WITH KEY ENGAGEMENT RELEASE OF HOLD-OPEN DETENT

The invention relates to a lock cylinder cover arrangement and more particularly includes a hold-open detent for retaining the cover in an open position and reliably returning of the cover to the closed position upon key rotation and subsequent key withdrawal from the lock cylinder.

BACKGROUND OF THE INVENTION

The present invention provides an improvement in the Lock Cylinder Cover With Key Engagement Release of U.S. Pat. No. 3,930,391 issued to Hans J. Borlinghaus Jan. 6, 1976 and assigned to the Assignee of this invention.

According to the Borlinghaus patent, a lock cylinder cover arrangement includes an escutcheon having an opening registering with the lock cylinder and a cover which is pivotally mounted on the escutcheon and is biased by a spring to a closed position covering the lock cylinder. A spring detent secured to the underside of the escutcheon includes a resilient arm having a stop surface which bears against the underside of the cover until pivotal movement of the cover to the fully open position permits the resilient arm to spring outwardly and engage the stop surface with a shoulder of the cover to hold the cover in the open position enabling the insertion of a key into the lock cylinder. The resilient arm also has a cam surface which the outward movement of the resilient arm poises in the path of unlocking rotation of the key so that the key engages the cam surface and cams the resilient arm inwardly to thereby release the stop surface from engagement with the shoulder of the cover so that the cover is first spring biased into engagement with the key and then subsequent removal of the key from the lock cylinder permits the cover to move to the fully closed position.

A shortcoming of the aforedescribed lock cover release arrangement is that under some circumstances the mechanism can be tricked to continue its hold-open of the cover in the open position even after the key has been rotated and then subsequently withdrawn from the lock cylinder. For example, it has been observed that gloves worn by a vehicle operator may inadvertently hold the cover in the open position during the unlocking rotation of the lock cylinder and during the subsequent counter rotation of the lock cylinder to its normal position after being unlocked so that the resilient arm is moved inwardly but then returns axially outwardly to return the stop surface into engagement with the shoulder of the cover, thereby re-establishing the hold-open retention of the cover in the open position. This same condition can occur when a vehicle operator unfamiliar with the attributes of the Borlinghaus invention uses his one hand to hold the escutcheon open while the other hand rotates the key.

The present invention provides an improvement to the Borlinghaus key engagement release arrangement which will assure that the resilient arm of the cover hold open detent spring will be retained at its inward release position reliably until the cover is moved sufficiently in the closing direction to prevent a re-engagement of the stop surface with the cover by the integral resilient action of the resilient arm.

SUMMARY OF THE INVENTION

More particularly, according to the present invention, a blocking lever is pivotally mounted on the underside of the escutcheon and is biased by a lever spring into engagement with the resilient arm of the detent spring. Upon axial inward movement of the resilient arm by the co-action of the key with the cam surface of the resilient arm, the blocking lever spring pivots the blocking lever to carry a blocking tab thereto into blocking engagement with the resilient arm to block the resilient arm in the axially inward position in which the stop surface thereof is withdrawn from engagement with the shoulder of the cover. This pivotal movement of the blocking lever to the blocking position simultaneously poises the opposite operating end of the blocking lever in the path of movement of an operating abutment carried by the underside of the cover. After the cover has rotated sufficiently toward its closed position so that its shoulder which is engageable by the stop surface of the resilient arm has moved beyond the stop surface, the operating abutment of the cover engages with the operating end of the blocking lever to rotate the blocking lever against the biasing effort of the blocking lever spring. This withdraws the blocking tab of the blocking lever out of engagement with the resilient arm so that the resilient arm is freed for subsequent axial outward movement of its stop surface and cam surface upon occurrence of subsequent opening movement of the cover to the open position.

Thus, the object, feature and advantage of the present invention resides in the provision of a spring biased blocking lever which moves into blocking engagement with the resilient arm of a cover hold-open spring upon intermittent movement of the resilient arm to the cover releasing position so as to provide assured release of the cover hold-open feature even though the cover may be momentarily manually held in its open position.

A further object, feature and advantage of the invention resides in the provision of a lock cover hold-open arrangement having a blocking lever adapted to block the hold-open latch in its unlatching position and having associated means for sensing the pivotal movement of the cover towards the closed position for withdrawing the blocking lever from its blocking position only after the extent of sensed cover opening movement assures that the hold-open feature cannot be reset and thereby the assured release of the hold-open arrangement is reliably provided.

BRIEF DESCRIPTION OF THE DRAWINGS

These and other features, objects and advantages of the invention will become apparent upon consideration of the following description and the accompanying in which.

DESCRIPTION OF THE PREFERRED EMBODIMENT

Figure 1:
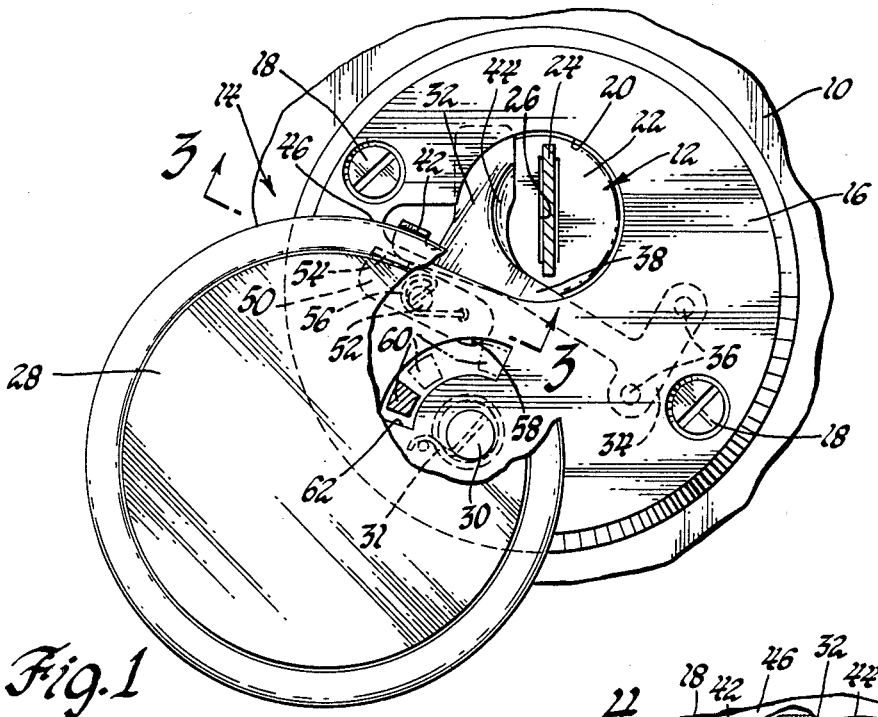
FIG. 1 is a fragmentary view of a vehicle trunk lid embodying the lock cylinder cover with assured release hold-open of this invention and having parts broken away and in sections.

Referring to FIG. 1, a conventional lock cylinder assembly 12 is mounted on a vehicle trunk lid 10 for operating a trunk lid latch.

A lock cylinder cover arrangement 14 includes a base or escutcheon 16 secured to the trunk lid 10 by screws 18 and having a central opening 20 therein which exposes an end surface 22 of the lock cylinder 12. A key 24 is manually inserted into a key slot 26 formed in the end surface 22 of the lock cylinder 12. Rotation of the key rotates the lock cylinder 12 and thereby operates the trunk lid latch to permit opening of the trunk lid.

The lock cylinder cover arrangement 14 also includes a cover 28 which is pivotally mounted on the escutcheon 16 by a pivot shaft 30. A spiral spring 31 encircles the shaft 30 and acts between the pivot shaft and the escutcheon 16 to bias the cover 28 from the open position shown in FIG. 1 to a closed position overlying the escutcheon 16 and covering the lock cylinder 12.

A hold-open detent 32 includes a support arm 34 which is secured upon the underside of the escutcheon 16 by fasteners 36. The hold-open detent 32 also includes an integral resilient arm 38 which extends across the central opening 20 of the escutcheon 16. An end portion of the resilient arm 38 is bent upwardly to provide a stop surface 42 and another end portion of the resilient arm 38 is bent upwardly to define a cam surface 44. The resilient arm 38 acts as a spring to bias the stop surface 42 and the cam surface 44 axially outwardly of the central opening 20 to the position shown in FIGS. 1 and 3. Thus, as the cover 28 is pivoted from the closed position, not shown, to the open position of FIG. 1, the stop surface 42 rides on the underside of the cover 28. When the cover 28 reaches the open position of FIG. 1, the spring action of the resilient arm 38 causes the stop surface 42 to be moved axially outwardly of the central opening 20 to the position of FIGS. 1 and 3 in which the stop surface 42 is engaged by the edge shoulder 46 of the cover 28 to hold open the cover 28 in the open position of FIG. 1.

The retention of the cover 28 in the hold-open position of FIG. 1 by the hold-open detent 32 facilitates the insertion of the key 24 into the key slot 26 by the vehicle operator. When the vehicle operator rotates the key 24 from the normal position of FIG. 1 to the unlocked position of FIG. 2, the rounded under edge of the key 24, as best shown in FIG. 3, will ride up on the cam surface 44 of the hold-open detent 32 to bias the resilient arm 38 axially inwardly of the central opening 20 and thereby forcibly move the stop surface 42 from the axially outward position of FIGS. 1 and 3 to the axially inward position of FIG. 4. This axial inward movement of the stop surface 42 withdraws the stop surface 42 from contact with the edge shoulder 46 of the cover 28 so that the spiral spring 31 pivots the cover 28 clockwise to the position of FIG. 2 where the edge shoulder 46 of the cover 28 engages the key 24. When the vehicle operator removes the key 24 from the key slot 26, the cover 28 is permitted to move further clockwise to its fully closed position.

The aforedescribed key actuated cover release for a lock cylinder is more fully described in U.S. Pat. No. 3,930,391 issued to Borlinghaus.

According to the present invention, a blocking lever 50 is added to the aforedescribed lock cylinder cover hold-open arrangement to assure release of the hold-open even though the vehicle operator may inadvertently hold the cover 28 in the FIG. 1 position during the rotation of the key 24 which would permit the resilient arm 38 to return the stop surface 42 into engagement with the edge shoulder 46 of the cover 28. More particularly, the blocking lever 50 is pivoted on the underside of the escutcheon 16 by a pivot pin 52. One end of the blocking lever 50 carries a downturned blocking tab 54. A spiral spring 56 encircles the pivot pin 52 and acts between the pivot pin 52 and the blocking lever 50 to urge the blocking lever 50 in the clockwise direction from the inactive position of FIGS. 1 and 3 engaging against the resilient arm 38 to the blocking position of FIGS. 2, 4 and 5.

Figure 2:
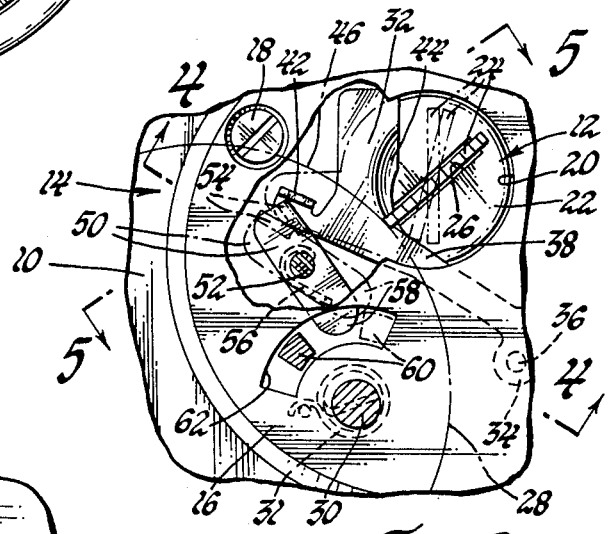
FIG. 2 is a view similar to FIG. 1 but showing the position of the cover subsequent to the rotation of the lock cylinder to an unlocked position by a key and partial closing movement of the cover.
Figure 3:
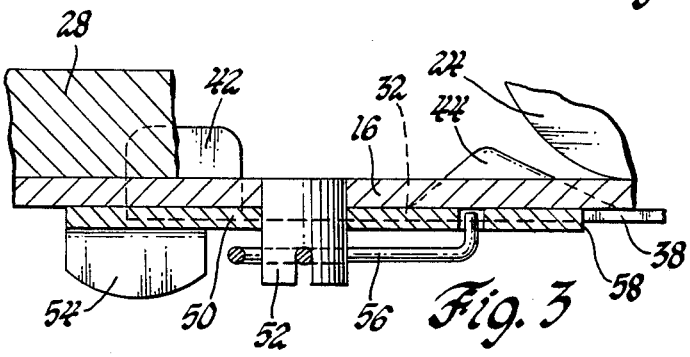
FIG. 3 is a sectional view taken in the direction of arrows 3—3 of FIG. 1.

As best seen in FIGS. 1 and 2, a lever operating abutment 60 projects from the underside of the cover 28 and reaches through a slot 62 in the escutcheon 16 for coaction with an operating end portion 58 of the blocking lever 50 as will be discussed further hereinafter.

Referring again to FIG. 1, it is seen that the cover 28 has been moved to the open position uncovering the lock cylinder 12. The resilient arm 38 of the hold-open detent 32 has sprung axially outwardly to move the stop surface 42 into engagement with the edge shoulder 46 of the cover 28, thereby holding the cover 28 open against the closing bias of the spiral spring 31.

In order to unlock the trunk lid 10, the vehicle operator inserts the key 24 into the key slot 26 and then rotates the key clockwise to the position of FIG. 2. This rotating movement of the key 24 causes the curved underside of the key 24 to ride along the cam surface 44 and thereby urge the hold-open detent 32 axially inwardly to withdraw the stop surface 42 away from engagement with the edge shoulder 46 of the cover 28. Thus, the spiral spring 31 is permitted to initiate clockwise closing movement of the cover 28. However, in some instances an inexperienced vehicle operator or a glove worn by the vehicle operator may hold the cover 28 in the open position.

Figure 4:
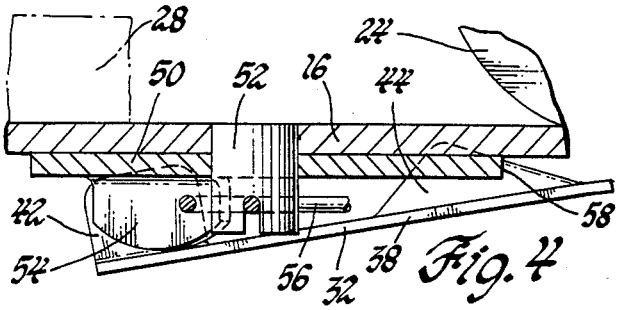
FIG. 4 is a sectional view taken in the direction of 4—4 of FIG. 2.
Figure 5:
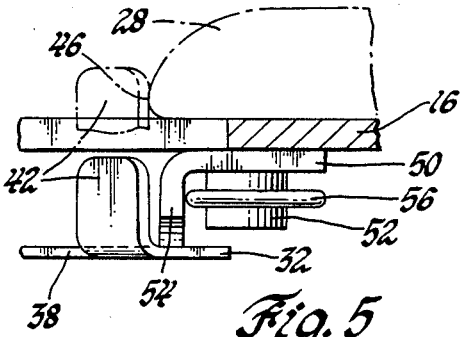
FIG. 5 is a sectional view taken in the direction of arrows 5—5 of FIG. 2 and showing the blocking lever holding the hold-open detent in the upper releasing position.

As shown in FIG. 4, the axially inward movement of the hold-open spring 32 is shown in FIG. 4 and withdraws the resilient arm 38 axially inward to unblock the blocking tab 54 of the blocking lever 50 so that the spring 56 is permitted to rotate the blocking lever 50 in the clockwise direction from its position of FIG. 1 to the position of FIGS. 2, 4 and 5 where the blocking tab 54 positively retains the resilient arm 38 of the hold-open detent 32 in its axially inward position irrespective of the location of the cover 28. Thus, even if the cover 28 is held in its open position of FIG. 1 by an inexperienced operator or by the gloved hand of an operator, the hold-open detent 32 is assuredly released and cannot return to the axially outward position for engagement with the shoulder 46 of the cover 28 after the key returns to its vertical position. Thus, as soon as the cover 28 is released by the vehicle operator or his gloved hand, the closing movement of the cover 28 is restored and the cover 28 will move toward the fully closed position. During such closing movement of the cover 28, the operating abutment 60 reaching through to the slot 62 moves in the clockwise direction of rotation and engages with the operating end portion 58 of the blocking lever 50 to urge the blocking lever 50 against the bias of the spiral spring 56 and thereby return the blocking lever 50 to its position of FIGS. 1 and 3. This unblocks the resilient arm 38 for limited axially outward movement to the position where the end of the stop surface 42 will again ride against the underside of the cover 28 and also enables the resilient arm to move further axially outward when the cover 28 is again returned to its fully open position of FIG. 1.

Thus, it is seen that the invention provides a new and improved lock cylinder cover arrangement in which the hold-open of the cover is assuredly released each time the key is rotated irrespective of the cover being manually held in the open position during such rotation of the key.

The embodiments of the invention in which an exclusive property or privilege is claimed are defined as follows:

1. A cover arrangement for a vehicle mounted key operated lock cylinder comprising:

an escutcheon mounted on the vehicle and having an opening registering with the lock cylinder;

a cover pivotally mounted on the escutcheon and having associated cover spring means biasing the cover to a closed position concealing the lock cylinder and yielding to permit movement of the cover to the open position to enable insertion of the key;

a spring detent carried by the escutcheon and including a resilient arm having a stop surface and a cam surface registering with the escutcheon opening, said resilient arm acting to urge said stop surface axially outward through the opening and into abutment with the cover to retain the cover in said open position and urge said cam surface to a position poised in the path of the rotating movement of the key so that key rotation to unlock the lock cylinder coacts with the cam surface to move the resilient arm inwardly and thereby withdraw the top surface from abutment with the cover to enable pivotal movement of the cover to the closed position; and auxiliary blocking means pivotally mounted on the escutcheon and acting between the cover and the resilient arm to retain the resilient arm in the inward position withdrawing the top surface away from the cover, said blocking means having associated operating means for removing the blocking means from blocking engagement with the resilient arm upon closing movement of the cover beyond the point of possible engagement thereof by the stop member of the resilient arm.

2. A cover arrangement for a vehicle mounted key operated lock cylinder comprising:

an escutcheon mounted on the vehicle and having an opening registering with the lock cylinder;

a cover pivotally mounted on the escutcheon and having associated cover spring means biasing the cover to a closed position concealing the lock cylinder and yielding to permit movement of the cover to the open position to enable insertion of the key;

a spring detent carried by the escutcheon and including a resilient arm having a stop surface and a cam surface registering with the escutcheon opening, said resilient arm acting to urge said stop surface axially outward through the opening and into abutment with the cover to retain the cover in said open position and urge said cam surface to a position poised in the path of the rotating movement of the key so that key rotation to unlock the lock cylinder coacts with the cam surface to move the resilient arm inwardly and thereby withdraw the top surface from abutment with the cover to enable pivotal movement of the cover to the closed position;

a blocking lever pivotally mounted on the escutcheon and having a blocking portion and an operating portion;

spring means biasing the blocking lever into blocking engagement with the resilient arm upon inward movement of the resilient arm by the cam surface to retain the resilient arm in the inward position in which the stop surface is withdrawn away from the cover; and means carried by the cover for engaging the operating portion of the blocking lever upon closing movement of the cover beyond the point of possible engagement thereof by the stop member of the resilient arm, said means carried by the cover pivotally moving the blocking lever to remove the blocking portion from blocking engagement with the detent to permit subsequent axial outward movement of the detent upon subsequent reopening of the cover.

* * * * *